United States Patent [19]

Beers

[11] 4,378,612

[45] Apr. 5, 1983

[54] DOOR CLOSER DELAYED ACTION SPEED CONTROL SYSTEM

[75] Inventor: Bruce N. Beers, Princeton, Ill.

[73] Assignee: Schlage Lock Company, San Francisco, Calif.

[21] Appl. No.: 243,888

[22] Filed: Mar. 16, 1981

[51] Int. Cl.[3] ..... E05F 3/22

[52] U.S. Cl. ..... 16/62; 16/49

[58] Field of Search ..... 16/62, 66, 69, 49; 49/137

[56] References Cited

U.S. PATENT DOCUMENTS

| | | | |
|---|---|---|---|
| 1,152,339 | 8/1915 | Norton | 16/62 |
| 2,790,991 | 5/1957 | Schlage | 16/62 |
| 3,220,047 | 11/1965 | Flint | 16/62 |
| 3,934,307 | 1/1976 | Lasier et al. | 16/69 X |
| 4,115,897 | 9/1978 | Zunkel | 16/62 X |

*Primary Examiner*—Paul A. Bell
*Assistant Examiner*—John S. Brown
*Attorney, Agent, or Firm*—Walter C. Vliet

[57] ABSTRACT

A delayed action door closer that delays a portion of the closing of a door for an adjustably determined period of time after the door has been moved to its fully open position. An interdependent hydraulic speed control system utilizes a delayed action speed control regulating valve which controls the closing speed of the door in the delayed action zone only, and whose speed cannot be adjusted faster than the main closing speed, but can be adjusted to provide a desired delay time prior to the door closing under normal regulation. The placement of the interdependent hydraulic system in the checking end of the closer allows the closer to have a fully adjustable independent backcheck.

8 Claims, 4 Drawing Figures

DOOR CLOSER DELAYED ACTION SPEED CONTROL SYSTEM

BACKGROUND AND SUMMARY OF THE INVENTION

Door closers of the kind to which the present invention relates include a piston or similar member slidable within a door closer body and driven in a door closing direction by a spring within the door closer. The piston is operatively connected to a drive means which responds to the movement of the piston in the door closing direction so as to cause closing movement of an associated door. Typically this is accomplished by means of a rack associated with the piston and pinion gear operatively connected to a lever, which in turn is connected to the door or door frame depending on the mounting location of the door closer. Hydraulic fluid is utilized to dampen the movement of the piston in the door closing direction. Valve means are usually provided to permit adjustment of the dampening effect.

A desirable feature of such door closers is the ability to retain the door in an opened position for a period of time prior to closing so as to permit unhindered passage through the door. This invention relates to a door closer, and more particularly to a delayed action door closer that delays the closing of a door for an adjustably determined period of time once the door has been moved to its fully open position. This invention further relates to the manner in which the above is acomplished; namely, an interdependent hydraulic delayed action speed control system.

It is an object of this invention to provide a delayed action regulating system in a delayed action door closer which may be adjusted to vary the time period in which the door closer delays the closing of a door during a delayed action stage.

It is a further object of this invention to provide an interdependent regulating system which maintains complete control of a door over its entire closing range, even when the delayed action portion of the system is not used.

It is a further object of this invention to provide an interdependent delayed action regulating system in the checking end of a door closer.

It is a further object of this invention to provide a delayed action regulating system in which the delayed action speed cannot be adjusted faster than the main closing speed of a door closer.

It is a further object of this invention to provide a delayed action regulating system which allows a door closer to have a fully adjustable, independent backcheck.

These and further objects are obtained in a door closing device comprising: A fluid filled cylinder; a piston within the cylinder forming a first, second and third chambers and slidable in opposite directions; a gear mechanism connected to the piston and adapted to be further connected to a pivotable door in order to transmit opening and closing movements of the door to the piston and vice versa; a spring or springs forceably biasing the piston in one of its slidable directions; a first valve means, a second valve means, and third valve means which sequentially control the flow of fluid from the first chamber to the second chamber; and a fourth valve means for controlling the fluid from the third chamber to the second chamber.

DESCRIPTION OF THE PREFERRED EMBODIMENT

Figure 2:
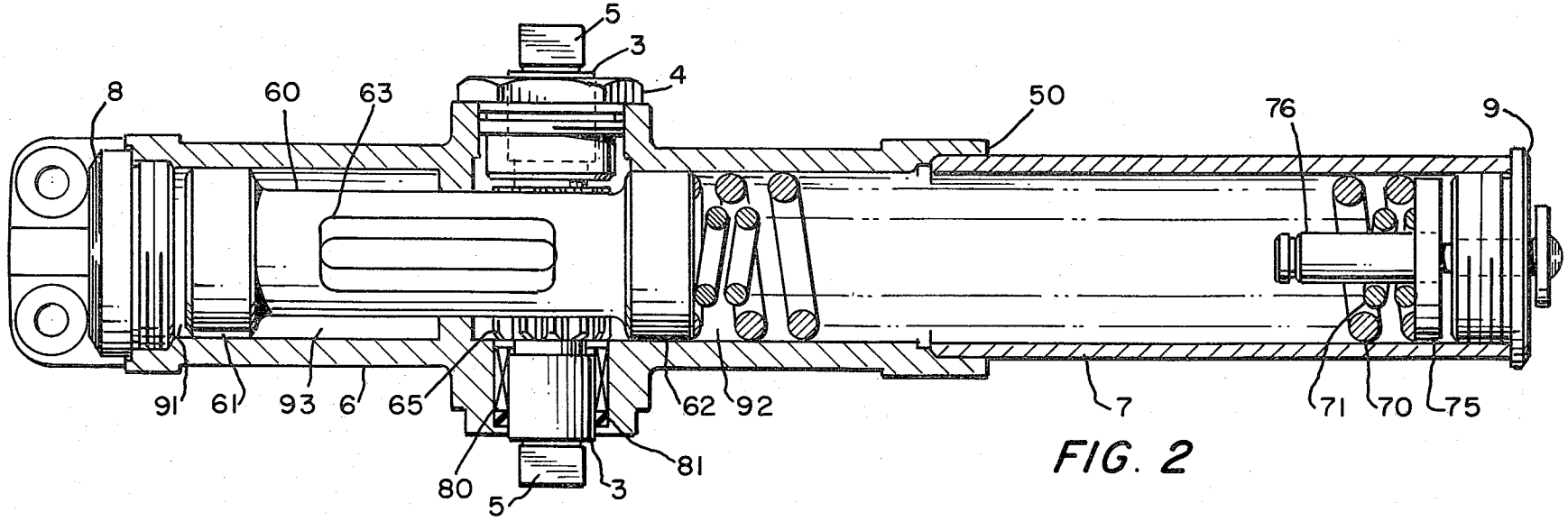
FIG. 2 is a cross section of the closer taken about section 2—2 of FIG. 1.
Figure 1:
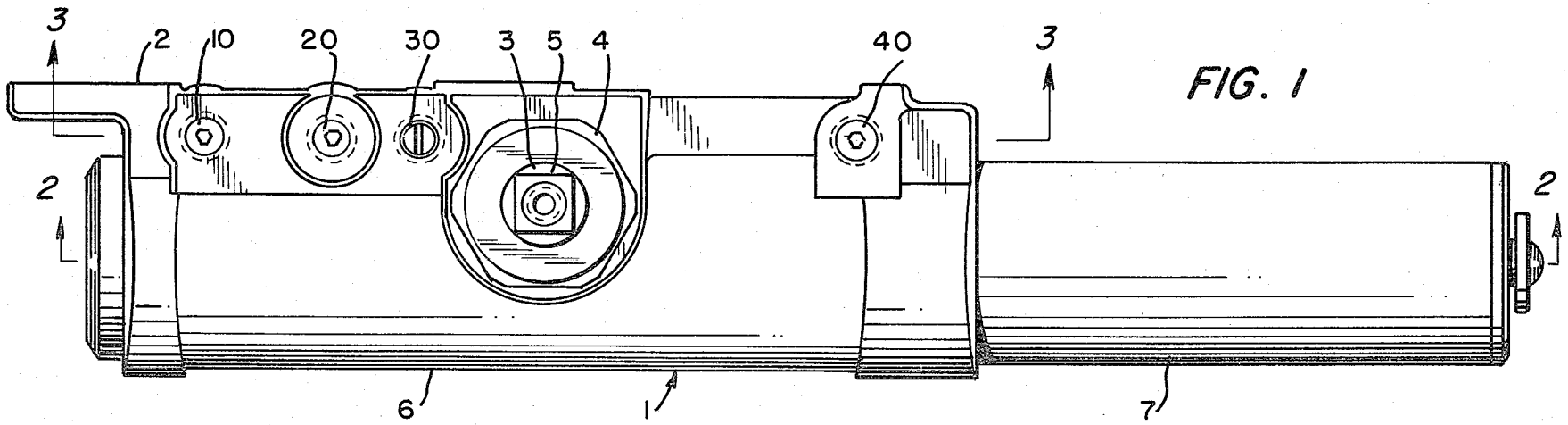
FIG. 1 shows a overall external view of the top of the door closer according to this invention showing the general external feature of this invention.

Referring to FIG. 1, the hydraulic door closer body is generally indicated by reference numeral 1. The body is mounted to either the door or door frame depending on the desired mounting location. The pinion shaft 3 is shown extending from the top of the door closer. The pinion is retained in the body by means of a pinion cap which is threadedly attached to the closer body in the preferred embodiment (as best seen in FIG. 2). Each end of the pinion shaft is provided with a keyed arm drive portion 5, shown here optionally as a square drive. The arm is not shown.

The body of the closer is generally formed as a hollow cylinder having appropriate end caps. As viewed in FIG. 1, the left hand portion of the body 6 contains a rack piston 60, and the right hand portion of the body 7 contains a spring 70 or springs 70 and 71 (best seen in FIG. 2). The adjustable valves are shown and may be identified as follows: When viewed from left to right, a latch speed regulating valve 10, a main speed regulating valve 20, a delayed action regulating valve 30, and a backcheck regulating valve 40.

Referring now to FIG. 2, the door closer body is provided with a piston end cap 8 on its left hand end. The body is also provided with a spring end cap 9 on its right hand end. The body is shown formed in two sections joined at a body coupling 50. The body coupling may be threaded, pressed, welded, or similarly joined.

Displaced within the body at the left hand end is a piston 60 having a forecheck piston head sealing surface 61 on its left hand end and a backcheck piston head sealing surface 62 on its right hand end. The two sealing surfaces are joined together by a rack section 63 (best seen on FIG. 4). The rack section coacts with pinion 65 which is attached to pinion shaft 3.

As can be appreciated by one skilled in the art, rotation of the door arm will in turn rotate the pinion shaft through the keyed arm drive 5, which in turn will rotate the pinion gear 65, and which in turn will drive the rack section 63 to the left or right as shown in FIG. 2. A heavy spring 70 is utilized to bias the piston 60 towards the door closed position as shown in FIG. 2.

In the case of the preferred embodiment, an auxiliary spring 71 may also be utilized to increase the bias force. The bias springs are adjustable by means of plunger plate 75 which is threadedly engaged to spring adjustment stud 76. Rotation of the spring adjustment stud will, therefore, displace plunger plate 75 to the left or right depending on the direction of rotation, thus compressing or relieving the bias springs. Spring adjustment stud 76 is free to rotate in spring end cap 9.

The pinion shaft 3 is mounted so as to rotate in the closer body. Bearing 80 retains the alignment of the pinion shaft. Seal 81 prevents loss of the hydraulic fluid. A similar bearing and seal is provided on the opposite end of the pinion shaft to support the shaft and prevent leakage through pinion cap 4. The interior of the closer body is filled with hydraulic fluid which must be displaced when piston 60 is driven in either the door opening or door closing direction. It is the control of the displaced fluid which accomplishes the present invention.

Figure 3:
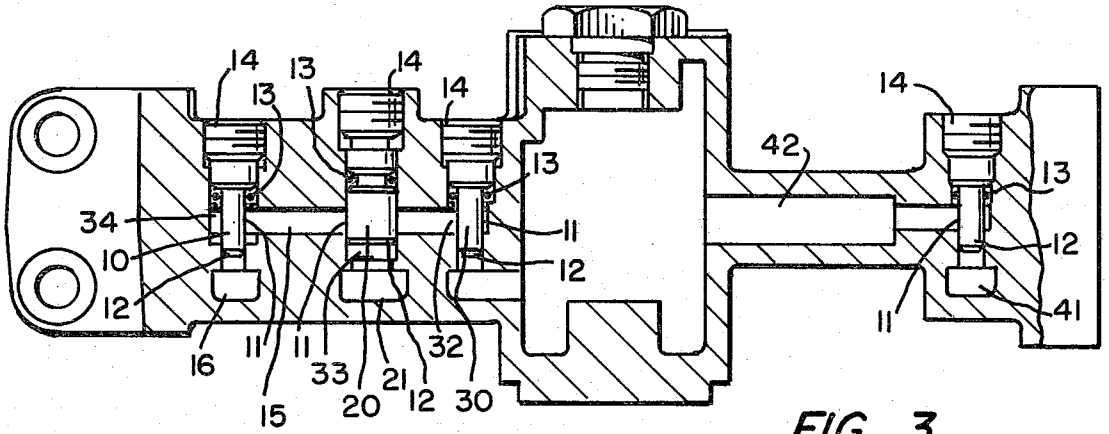
FIG. 3 is a cross section of the hydraulic valve chest taken about section 3—3 of FIG. 1.

FIG. 3 shows the hydraulic valve chest in cross section and the relative location of the various hydraulic control valves required to perform the desired control functions. Each of the valves are typical hydraulic metering valves having a sealing surface 11 and a metering section 12. Each of the stems are provided with a seal 13 and a threaded adjustment screw 14. Typically adjustment is accomplished by rotating the valve by means of a screw driver cross slot or hex drive socket (for Allen wrench adjustment), or other suitable means.

Figure 4:
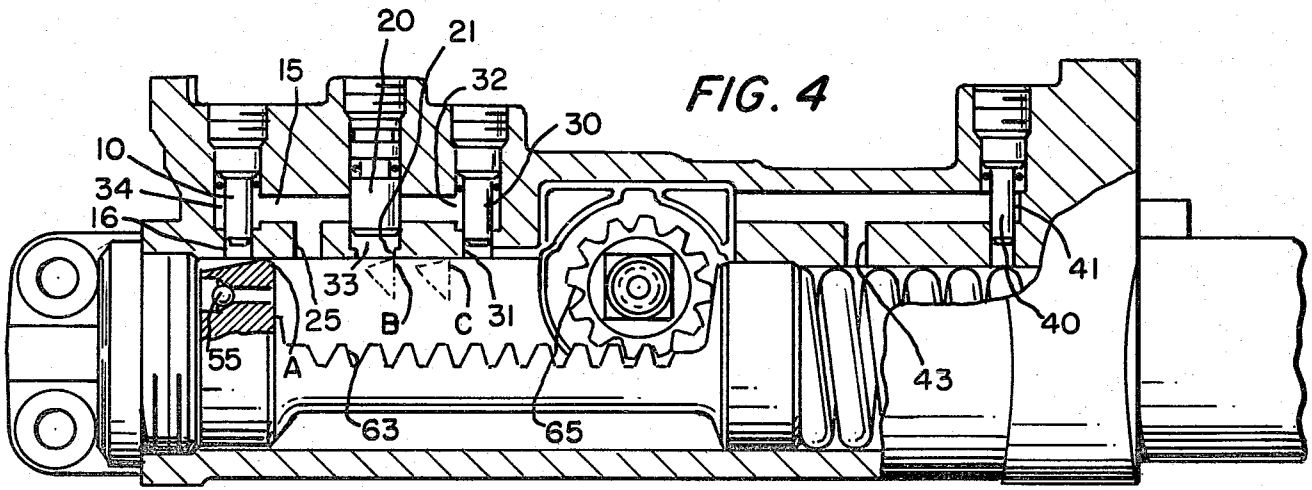
FIG. 4 is a partially modified cross section having the valve chest rotated 90° to assist in the ease of description of the hydraulic system.

Referring to FIG. 4 which has been modified by rotating the valve chest 90° to better explain the hydraulic function, the piston head 61 is shown in the home position (i.e., the position of the piston within the closer cylinder when the door is in the fully closed position). FIG. 4 shows a fluid passage 25, which connects with the main bore of the cylinder and a communicating port 15. Communicating port 15 passes through the latch speed regulating valve port 34 and main speed regulating valve port 33, and into, but not through, the delayed action valve port 32. The passage 25, regulating valve ports, and communicating port 15 are the paths through which the fluid flow is directed. The regulating valves, when inserted into their respective ports and placed in a specific position, cause the fluid to pass at a thereby restricted rate, thus determining the closing speed of the door.

FIG. 4 shows the arrangement of the speed control system, the piston head 61 in its position designated C when the door is opened to its fully open position, and the delayed action regulating valve 30 adjusted in a manner such that the rate at which fluid will pass by the valve will be greatly attenuated. Because the piston 60 is spring biased to the left as shown, it will begin moving in that direction when the door is released after it has been opened. As in any hydraulic door closer, the fluid, in combination with the regulating valves and ports, controls the speed at which the piston will move, and thereby controls the closing speed of the door. In this delayed action regulating system, the point at which the door is released and the piston 60 begins to move in the direction shown in FIG. 4, fluid is forced into main speed regulating valve port 33 and past the main speed regulating valve 20, where it is initially metered. The fluid then flows into the delayed action regulating valve port 32 and past the delayed action regulating valve 30, where it is metered to an even slower rate of flow. The fluid is then discharged through passage 31 into the low pressure area behind the piston head.

Because the delayed action regulating valve 30 passes the fluid at a slower rate than that of the main speed regulating valve 20, the door will close very slowly while the piston head is moving within the delayed action zone. This zone is defined as the area within the door closer cylinder in which the piston head 61 is positioned when the door is opened anywhere from 180° to approximately 70° door open position. At approximately 70° door open position, the delayed action zone ends, and the main speed zone begins. The major point concerning this delayed action system is that the fluid always passes through the main speed valve port 33 first, where it is initially metered by the main speed regulating valve 20, and then flows into the delayed action port 32, where it is metered to an even slower rate by the delayed action regulating valve 30. The rate at which fluid can be passed by the delayed action regulating valve 30 can be adjusted slower than the rate of the main speed valve 20, but it can never be adjusted any faster than the main speed rate, because of the fact that the fluid is always initially metered at the main speed rate. This eliminates any chance for a door closing uncontrollably when the delayed action portion of the speed control system is not used, that is, when delayed action valve 30 is placed in a position within delayed action port 32 so as to cause no attenuation of fluid flow.

With the delayed action regulating valve 30 placed in a position where fluid is allowed to flow freely past the valve (i.e., no attenuation takes place), and with the piston head in its position with respect to a fully opened door, fluid is forced into the main speed regulating valve port 33 and past the main speed regulating valve 20, where it is metered at the main speed rate. Because the delayed action valve 30 causes no attenuation in this arrangement, fluid flows freely past the delayed action valve 30 and into the low pressure area behind the piston head 61. The rate at which fluid is flowing past the delayed action valve 30 (and the speed at which the piston 60 is moving) is the rate at which fluid is being passed by the main speed valve 20. Therefore, even with the delayed action valve 30 causing no attenuation of fluid flow, the door is closing controllably at the main speed rate.

With the piston head 61 in position B as it has just uncovered the area 21 where the main speed regulating valve port 20 connects with the main bore of the cylinder, fluid entering the speed control system through passage 25 is forced into the main speed regulating valve port 33, past the main speed regulating valve 20, where it is regulated to the main closing speed. Because the fluid now has a free flow path to the low pressure area behind the piston head 61, the fluid exits the speed control system through the main speed port 33 and is not forced to the delayed action port 32. At this point, the delayed action portion of the door closing cycle has ended.

The door continues to close under control of the main speed regulating valve 20 until the piston head 61 passes fluid passage 25. At this point, fluid enters the speed control system only through area 16 and into the latch speed valve port 34 and passes the latch speed regulating valve 10, where it is metered at the latch speed rate. Because the fluid has a free flow path through passage 25 to the low pressure area behind the piston head 61, it will not be forced through the main speed regulating port 33 for further metering. The fluid therefore exits the speed control system through passage 25, and the door will complete its closing phase under control of the latch speed regulating valve 10.

FIG. 4 also illustrates the arrangement of the hydraulic backcheck system. The backcheck regulating valve port 41, fluid passage 43, and a communicating port 42, which passes through both the backcheck regulating valve port 41 and the fluid passage 43, direct the flow of fluid in the backcheck end of the door closer. As the door is opened, fluid is forced into fluid passage 43 and back to the low pressure or reservoir area behind the piston head 62 through the communicating port 42. No checking action is taking place at this time because the fluid has a free flow path. As the piston head covers fluid passage 43 as the door is opened to approximately 70°, backcheck begins to take place.

After the piston head covers passage 43, the fluid flow path changes. Fluid enters the system through the backcheck regulating valve port 41 and is forced past the backcheck regulating valve 40, where it is metered. The metered fluid then dumps into the low pressure area behind the piston head 62 through communicating port 42. The intensity of the backcheck can be fully adjusted by adjusting the placement of the backcheck regulating valve 40 within its port 41. This adjustment is totally independent from the closing speed control system previously described.

A relief check valve 55 is provided in the head 61 of the piston 60 to permit free flow of fluid to chamber 91 during the opening of the door.

Hydraulic fluid which is utilized to control the movement of the piston 60 is encased within the cylinder cavity. This hydraulic fluid fills the cavities found at each end of the piston 60 as well as the reduced center portion 63. Referring to FIG. 2, the cavity formed to the left of the piston head sealing surface 61 may be referred to as the forecheck cavity 91. The cavity formed to the right of the piston head sealing surface 62 may be referred to as the backcheck cavity 92. Backcheck cavity 92 houses the bias springs 70 and optionally 71 as shown. The cavity formed about the reduced center portion of the piston may be referred to as a reservoir cavity 93. The reservoir cavity also houses the rack 63 and pinion gear 65.

It is to be understood that various alterations, modifications and/or additions may be introduced in the above described embodiment without departing from the spirit or ambit of the invention as defined by the following claims.

I claim:

1. A door closing device comprising:

a fluid filled cylinder;

a piston reciprocally and slidably displaced within said cylinder forming a first, second and third chambers;

a gear mechanism connected to said piston and adapted to be further connected to a pivotable door in order to transmit opening and closing movements of the door to the piston and vice versa;

a spring forceably biasing said piston in one of its slidable directions;

a first valve means, a second valve means, and third valve means which sequentially control the flow of fluid from said first chamber to said second chamber;

a fourth valve means for automatically controlling said fluid from said third chamber to said second chamber;

said piston is formed with a piston head and sealing surface at each end jointed together by a reduced center rack gear section;

said rack section cooperates with a pinion gear to connect said piston to a pivotable door;

said reduced portion of said piston forms said second chamber;

a first passage means connects said first chamber with said second chamber sequentially through said first valve means, said second valve means and said third valve means;

a second passage means communicating between said third chamber and said second chamber through said fourth valve means; and a third passage means communicating said first fluid passage alternately with said first chamber and said second chamber at a point between said first valve means and said second valve means.

2. A door closing device according to claim 1 wherein:

a fourth passage means communicates between said third chamber and said second passage means as a bypass for said fourth valve means during a portion of the movement of said piston towards said third chamber.

3. A door closing device according to claim 2 wherein:

said fourth valve means is an independent backcheck regulating valve.

4. A door closing device according to claim 1 wherein:

said first valve means is a latch speed regulating valve;

said second valve means is a main speed regulating valve; and said third valve means is a delayed action regulating valve.

5. A door closing device according to claim 1 wherein:

said piston is provided with a one-way flow passage between said second chamber and said first chamber permitting flow from said second chamber to said first chamber, but not vice versa.

6. A door closing device according to claim 1 wherein:

said spring is adjustable to effect a desired biasing force.

7. A door closing device according to claim 1 wherein:

said first valve means, said second valve means, and said third valve means are adjustable to effect the flow of fluid from said first chamber to said second chamber during the closing of said door.

8. A door closing device according to claim 1 wherein:

said fourth valve means is independently adjustable for controlling said fluid flow from said third chamber to said second chamber during the opening of said door.

* * * * *